United States Patent [19]

Duerksen, deceased

[11] 4,019,003

[45] Apr. 19, 1977

[54] MULTI-DIRECTIONAL SENSOR SWITCH WITH AUXILIARY ACTUATING STRUCTURE

[75] Inventor: Arnold Duerksen, deceased, late of Salinas, Calif., by Mildred Eva Judge Duerksen, executrix

[73] Assignee: Cochran Western Corporation, Salinas, Calif.

[22] Filed: Nov. 21, 1975

[21] Appl. No.: 634,159

[52] U.S. Cl. ..... 200/61.42; 200/330

[51] Int. Cl.² ..... H01H 3/16

[58] Field of Search ..... 200/6 A, 18, 17 R, 61.42, 200/61.71–61.84, 159 R, 329, 330, 331, 332, 335–340

[56] References Cited

UNITED STATES PATENTS

| | | | |
|---|---|---|---|
| 455,005 | 6/1891 | Palmer | 200/61.71 |
| 2,927,988 | 3/1960 | Powell | 200/159 R |
| 3,223,814 | 12/1965 | Kalbitz | 200/61.82 X |
| 3,267,248 | 8/1966 | Bagley | 200/330 |

*Primary Examiner*—James R. Scott
*Attorney, Agent, or Firm*—Forrest J. Lilly

[57] ABSTRACT

A sensor switch is described for use within an object handling conveying system such as a baggage conveying system, adapted for actuation by passing objects, such as baggage, though not limited thereto, or a transport vehicle, for objects or materials, by engagement against an upstanding sensor element.The sensor element comprises a semi-elliptical shell, topped by a vertical stem, and is mounted for depression and angular deflection, against spring support means, when engaged laterally by a unit object, or a transport vehicle. The spring support means includes an element which actuates a microswitch when the sensor element is thus depressed and/or tilted. The circuit of the microswitch energizes an indicator, such as a signal light, for information of a distantly located operator.

8 Claims, 4 Drawing Figures

MULTI-DIRECTIONAL SENSOR SWITCH WITH AUXILIARY ACTUATING STRUCTURE

BACKGROUND OF THE INVENTION

1. Field of the Invention

This invention relates generally to electric sensor switches, of a type adapted for actuation by a moving object which may approach and engage it from any direction in a horizontal plane, and more particlarly to a mechanical sensor adapted for mounting in an object handling conveying system, and adapted to be egaged and deflected either by individual objects, or a transport for objects or materials travelling along said conveying system.

2. Description of the Prior Art

Switches for the general purpose of electric circuit actuation as a sensor is engaged by travelling objects have been known, such as the known wobble action or whisker switches familiar to those skilled in the art, but these have faults particularly in that they are subject to damage by over-actuation, or change in direction of the object being transported. Insofar as internal construction is concerned, the nearest approach to the present sensor switch of which I am aware is the disclosure in U.S. Pat. No. 2,927,988 to D. G. Powell. Therein, however, a push button stem is essentially constrained to axial travel by a longitudinal or endwise thrust, and is not adapted to function in response to lateral engagement by an object or a transport vehicle.

Summary of the Invention

The present invention provides a novel sensor adapted for mounting in a well in a conveying system, adapted to project vertically thereabove to be engaged by a unit object, or a transport vehicle being propelled along the floor and carrying a number of such objects. The sensor comprises an upwardly convergent body, in the general form of a surface of revolution about a normally vertical axis, and includes a vertically projecting substantially rigid stem at the top. Under this body, and pressing upwardly against a seat around its large lower end, is the upper end of a coil compression spring, the lower end of which bears down on a vertically movable push pin. The push pin is provided with a biasing spring, lightly opposing the first-mentioned spring, and acting essentially to position the push pin 38 normally in the position of FIG. 2, wherein its lower extremity is elevated sufficiently for the microswitch actuating element 32 to be fully returned to its normal unactuated position. When the transported object or transport vehicle laterally engages and overrides either the upwardly convergent sensor body, or the vertical stem thereof, the body lowers and tilts, increasing the force exerted by the spring 50 on the push pin, and thus pushing down the push pin against the spring bias exerted thereon by spring 46, and the push pin in turn operates a microswitch against its internal return spring. The microswitch in turn controls the circuit of an indicator light located within view of an operator. Illumination of this indicator light shows that the object, or transport vehicle, has reached the corresponding sensor station, and that the associated sensor has sensed such fact. This information thus conveyed to the operator is utilized according to procedures known in the art.

DETAILED DESCRIPTION OF AN ILLUSTRATIVE EMBODIMENT

Figure 1:
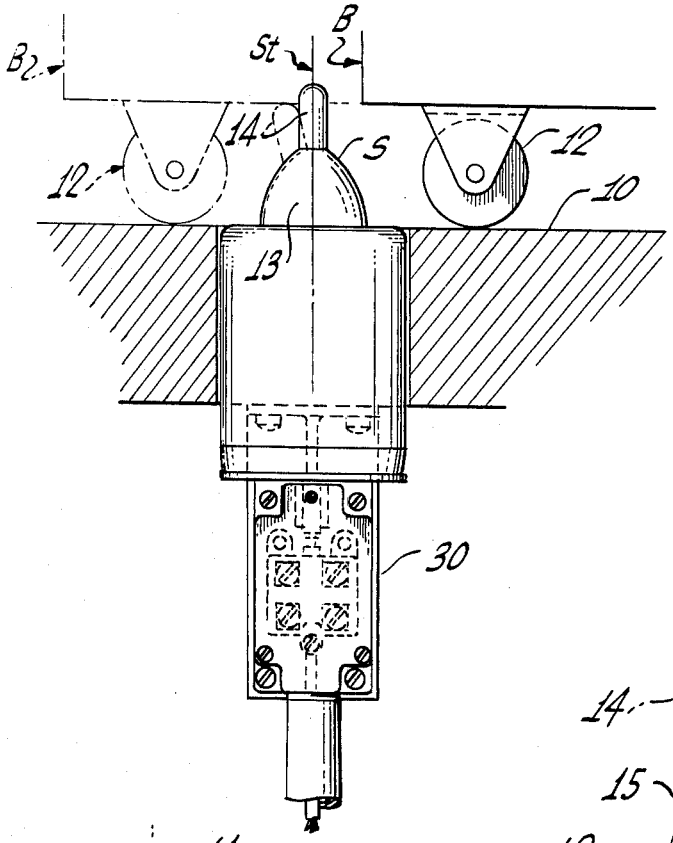
FIG. 1 is an elevational view of the sensor of the invention, shown installed in the floor of a conveyor system, and showing the case wherein the material or object conveyed is carried by a wheeled transport running on such floor.

In the drawings, numeral 10 designates generally a floor along which objects, or a transport vehicle, may be transported, for example, in a baggage transportation facility at an airport. This application is representative of the invention in a present specific field of use, but the invention is not limited to such use. The object may slide along this floor or it may be loaded on a wheeled transport which rolls along the floor, such as diagrammatically represented at B. The object, or transport B, is shown in FIG. 1 as supported by small diameter wheels or rollers 12 running on the floor 10, sufficiently spaced above the floor 10 to engage and deflect a sensor S at a predetermined station St. Thereby, the sensor is deflected and depressed, as to an actuated position (FIG. 2 in phantom lines, or FIG. 3) to operate a later described switch *Sw*. The sensor has an upwardly tapered hollow body 13, in the form of a figure of revolution about a vertical axis, preferably somewhat in the nature of a half of an ellipsoid, with its closed end up. This closed end includes a surmounting vertical stem 14. The lower, large end of the hollow body 13 has a peripheral annular flange 16, angled upwardly at about 45°, which forms an annular, rounded-bottom channel 18, normally (in the position of FIG. 2) engaged by a peripheral inwardly and downwardly directed confining lip 20 formed on the upper end of a cylindrical housing shell 22. The sensor body and stem are preferably composed of a suitable smooth surfaced hard plastic.

Shell 22 is mounted in a cylindrical bore 23 through floor 10, with its upper extremity flush with the upper surface of the floor. The lower end of the shell is closed by plug 24, and fastened to the underside of the latter is a housing 30 for microswitch *Sw*, having an upwardly projecting actuating pin 32. The latter is in its normal upper position in FIG. 2, and has a range of downward switch closing travel substantially equal to the height of the pin 32 above the top side 33 of the microswitch body 34 in FIg. 2. This downward travel of the actuating pin 32 is yieldingly opposed by the usual interior return spring, not shown.

A nylon bushing 36 is mounted in the top wall of the housing 30, and projects both above and below said wall, terminating at the bottom above pin 32, and at the top at a level to accommodate the vertically downward deflection of the presently described push pin 38.

Push pin 38, slidably receivable in bushing 36, normally engages the upper end of microswitch actuating pin 32, and has, at its upper extremity, an enlarged cylindrical head 40, immediately below which is a still larger annular flange 42. The push pin is preferably necked down within the bushing 36 to receive an O-ring seal 44. The upper end of a small coil compression bias spring 46 engages the underside of pin flange 42, and the lower end thereof seats on the lower wall 47 of plug 24. This small spring 46 acts upwardly against an opposing, slightly compressed, relatively large conical coil compression spring 50 (presently to be described), to hold the push pin 38 normally in its illustrated upper unactuated position.

Conical coil compression spring 50 seats at its small lower end on the top of the aforementioned flange 42, and at its large end against a confined downwardly facing annular seat 51 formed in the underside of the peripheral annular flange 16. It yieldingly opposes both axial depression of the sensor stem 14, and combined axial depression with lateral tilting, as shown in phantom lines in FIGS. 1 and 2, and in full lines in FIG. 3, when the sensor is engaged by an object or an object transport B.

Arrangements are made such that the travelling objects, or transport, horizontally engage, and then depress and override the sensor S, engaging either its stem 14, or its half-elliptical body 13. In the latter case, the body 13 will be cammed over and down by, for example, a corner portion of the transport B, and thereafter, the portion of the transport engaging the elliptical surface of the body 13 having reached and engaged the stem 14, the stem and body will be further depressed and/or tilted, for example, to the position of FIG. 3. It will be clear that any of various combinations of depression and tilting actions, depending upon circumstances, will compress the spring 50 downwardly, overcoming the bias spring 46, and the internal microswitch spring, so as to push the pin 38, and therefore the microswitch pin 32, downwardly to actuate the microswitch.

If desired, a third spring 62, of a cylindrical coil compression type, may be used in aid of spring 50, seating at the bottom on flange 42 inside spring 50, and at the top in the upper end of the hollow actuator body 15.

Figure 2:
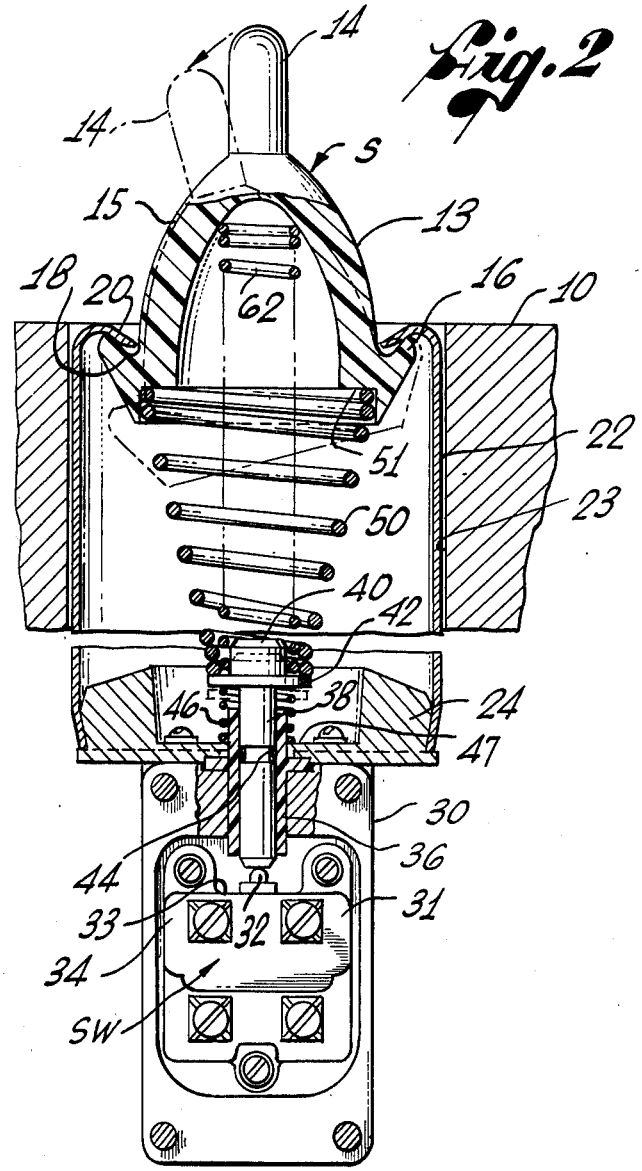
FIG. 2 is a longitudinal vertical section of the sensor of FIG. 1.

Thus, in the normal, undeflected, full-line positions of FIGS. 1 and 2, the spring 50, together with the spring 62, if used, press down on the push pin 38. the springs 50 and 62 are relatively extended in that position, and are balanced by the biasing return spring 46, so the assembly stands normally in the position of FIG. 2, with the microswitch S*w* unactuated.

Figure 3:
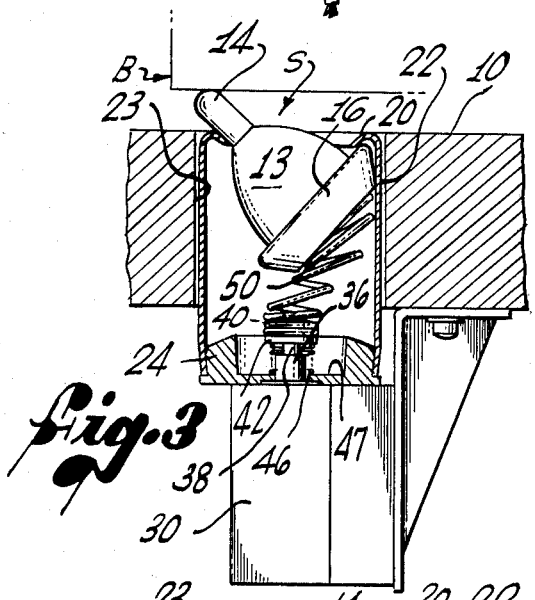
FIG. 3 is a view similar to a portion of FIG. 2, but showing the sensor more deeply depressed by a unit of material with a lower bottom, illustrating deeper depression of the sensor.

Assume now the front end of a transport vehicle travelling toward the left in any one of FIGS. 1, 2 or 3. In FIGS. 1 and 2, full line positions, the sensor S has not yet been engaged by the transport, but in the phantom line position, it has been engaged and deflected through an angle, and also lowered, until it can be overridden by the transport. Thereby, the springs 50 and 62 are compressed downwardly enough to overcome the bias return spring 46, as well as the unillustrated microswitch return spring, so the push pin 38 lowers the microswitch pin 32 to actuate the microswitch.

With a lower bottom on the transport (FIG. 3), the lower corner portion thereof, for example, may engage the tapered or substantially elliptical wall of the sensor body 13. In this case, body 13 is pushed down and tilted toward the left. The lower front corner portion of the transport pushes the body 13 down and over, until the base of the stem 14 is engaged, and then overrides the stem, with the sensor body 13 held in the switch-closing position of FIG. 3, and the springs 50 and 62 in increased compression. The push pin 38 is thereby depressed against bias spring 46 and the internal microswitch spring, and microswitch pin 32 is lowered to actuate the microswitch. When the transport thereafter passes on, the springs return the parts to their initial position as shown in FIGS. 1 and 2.

Figure 4:
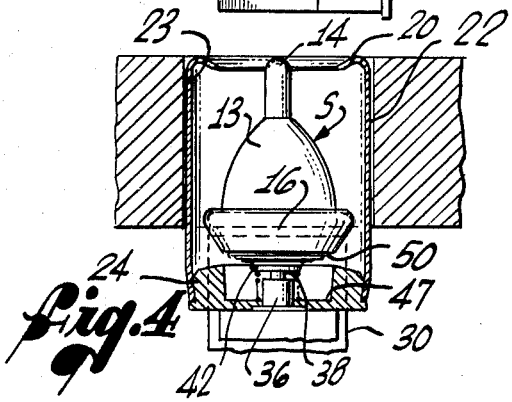
FIG. 4 is a view similar to FIG. 3, but showing the sensor totally depressed and contained within its housing, flush with the conveying system level.

In the event the stem 13 should be stepped on or rolled over by a wheel, or by an object being dragged over the surface of floor 10, the sensor 13, including the stem 14, can sink into the fully retracted, flush-with-floor position of FIG. 4.

As the transported object is either moved over the area in which the sensor S of the invention is located by a transport vehicle, or is dragged thereover by sliding it along the conveyor floor, the microswitch S*w* is actuated. As earlier mentioned, such switch actuation can control a signal light, which light can be located at a controller's station, and illumination of such light will indicate to such operator that the object in question, or a transport carrying a load of articles, has reached a designated location in the system. Use of such a signalling system may be as previously known in earlier systems.

The sensor switch of the invention has been contrived to have the features preliminarily sought. These features include ruggedness against damage; and the ability to respond to or be actuated by objects or a transport vehicle approaching from any direction. The switch, in service, has also the unique quality that after preliminary deflection in a given direction by an individual object or transport, it will not be damaged by a change in direction of travel, but will simply automatically conform thereto.

The drawings and description will be understood to be merely representative of many physical forms in which the invention can be embodied in practice, and many changes in design, structure and arrangement may be made without departing from the spirit and scope of the invention as defined in the appended claims.

What is claimed is:

1. A sensor adapted for mounting at a signal station in a conveyor system for actuation by transport of an object to said station along a predetermined path of travel, comprising:

a sensor housing set into said system floor, said housing including a top portion with a wide upwardly facing, annular opening therein defined by an inwardly extending lip, a sensor body in the external form of an upwardly convergent figure of revolution about a normally vertical axis, said body being receivable into said housing and being configured for engagement under said lip, and for projection and convergence thereabove, and said body including a stem extending upward from its convergent upper end, a spring abutment positioned below said sensor body and quided by means on said housing for substantially vertical travel relative to said housing, a coil compression spring acting between said sensor body and said spring abutment to hold said sensor body normally yieldingly up against said lip, a switch actuating element on said spring abutment, a microswitch having an operating element engaged and deflected by said actuating element, and said sensor body being responsive to external forces to cause lateral and downward deflection thereof to move said switch operating member so as to actuate said microswitch.

2. The sensor of the claim 1, wherein said sensor body is adapted for actuation by virtue of horizontal engagement by either an object being transported or a transport for such an object travelling along said conveyor floor and over said station.

3. The subject matter of claim 2, wherein:

said switch actuating element comprises a vertically disposed push pin, and a vertical guide in said housing below said sensor body for sliding reception of said push pin, said spring abutment being on the upper end of said push pin, and being afforded with an upwardly facing spring seat for said coil compression spring.

4. The subject matter of claim 3, wherein said microswitch includes an actuating pin normally engaged by said push pin, and movable by said push pin by virtue of compression of said coil spring owing to downward deflection of said sensor body.

5. The subject matter of claim 1, wherein said sensor body, inclusive of its said stem, has a range of reception into said housing to a depth at which said stem is received inside the top level of said lip.

6. The subject matter of claim 1, wherein said lip extends downwardly as well as inwardly, and said body has at its lower end an external peripheral flange which angles upwardly and outwardly to interengage with said downwardly and inwardly extending housing flange.

7. The subject matter of claim 1, wherein said coil spring is conical, with its large end in engagement with a downwardly facing spring seat formed in the peripheral region of the lower end portion of the sensor body.

8. The subject matter of claim 3, including also a relatively light coil compression bias spring supported at a lower end thereof by said housing and acting upwardly at its upper end on said spring abutment, in opposition to said first-mentioned compression spring, to assure re-elevation of said push pin against opposition of said first-mentioned coil spring, and thereby avoid impediment to return of said microswitch operating element.

* * * * *